US007900861B2

(12) United States Patent
Sharp

(10) Patent No.: US 7,900,861 B2
(45) Date of Patent: Mar. 8, 2011

(54) TEETH FOR GRINDING APPARATUS

(75) Inventor: Rodney Warwick Sharp, Hamilton (NZ)

(73) Assignee: Progressive IP Limited, Hamilton (NZ)

( * ) Notice: Subject to any disclaimer, the term of this patent is extended or adjusted under 35 U.S.C. 154(b) by 494 days.

(21) Appl. No.: 10/594,524

(22) PCT Filed: Mar. 29, 2005

(86) PCT No.: PCT/NZ2005/000060

§ 371 (c)(1),
(2), (4) Date: Sep. 18, 2008

(87) PCT Pub. No.: WO2005/093173

PCT Pub. Date: Oct. 6, 2005

(65) Prior Publication Data

US 2009/0008491 A1 Jan. 8, 2009

(30) Foreign Application Priority Data

Mar. 29, 2004 (NZ) ..... 532006

(51) Int. Cl.
*B02C 18/28* (2006.01)

(52) U.S. Cl. ..... 241/294

(58) Field of Classification Search ..... 241/236, 241/291, 294

See application file for complete search history.

(56) References Cited

U.S. PATENT DOCUMENTS

| | | | | |
|---|---|---|---|---|
| 4,826,090 | A * | 5/1989 | Orphall | 241/191 |
| 6,108,896 | A | 8/2000 | Gignac et al. | |
| 7,100,855 | B2 * | 9/2006 | Diemunsch | 241/236 |
| 7,469,852 | B2 * | 12/2008 | Sharp | 241/236 |
| 2005/0001084 | A1 * | 1/2005 | Pizzuto | 241/294 |
| 2005/0035234 | A1 * | 2/2005 | Roozeboom et al. | 241/195 |
| 2006/0243840 | A1 * | 11/2006 | Latham | 241/294 |

FOREIGN PATENT DOCUMENTS

| | | |
|---|---|---|
| AU | 63759/98 | 11/1998 |
| DE | 3520370 | 12/1986 |
| EP | 0 046 452 | 8/1981 |
| FR | 2256996 | 9/1975 |
| FR | 2846017 | 4/2004 |
| JP | 7190024 | 7/2006 |

* cited by examiner

*Primary Examiner* — Faye Francis
(74) *Attorney, Agent, or Firm* — Young & Thompson

(57) ABSTRACT

A replaceable tooth arrangement for use in grinding discs such as used in wood hoggers and comminuting equipment. A preferred tooth arrangement includes two end to end adjacent tip portions, or a tip portion end to end with a complementary base portion. The contacting faces of the portions are preferably tapered so that tightening together creates a resultant outward movement which tightens them against the walls of a retaining aperture in a disc or disc section. Alternatively or additionally a connection element interacts with a wedge keeper which causes a similar outward component in the keeper and tip portion, tightening them against the walls of a retaining aperture, as the connection element is tightened.

18 Claims, 6 Drawing Sheets

TEETH FOR GRINDING APPARATUS

FIELD OF INVENTION

The present invention relates to a replaceable tooth assembly for use in grinding and chipping operations. Generally such teeth are mounted in grinding discs and drums. Typical uses include breaking down and chipping wood, rocks, demolition materials, recycled roading, tyres and other materials.

BACKGROUND DESCRIPTION

The present invention was initially developed with problems associated with the comminution of wood and timber materials in mind, and took into account problems associated with apparatus such as wood hoggers. However, such devices are now used for breaking down a range of other materials, rather than simply just wood. As an example of the types of materials that hoggers are now used to break down, are included materials such as: soft rocks, hard rocks, mild and thin scrap steels, various soft and mild scrap metals, masonry and cementitious demolitions materials, recycled roading such as asphalt and coarse chip roading surfaces, old tyres, green plant material, etc. As can be appreciated these materials cover a significant range of hardnesses, and other properties. Recycled roading may include hard rock material, while tyres include a significant proportion of steel from the belts and beads. These present a range of effects on the teeth of grinding assemblies.

While for simplicity reference may often be made to wood hoggers (regardless of the material they are required to break down), it should be appreciated that the present invention may be used in grinding discs, drums, and apparatus of all kinds and including, in particular, rock crushers and devices for breaking down scrap metal, as well as hoggers per se. It should be realised that descriptions given here in relation to wood hoggers are applicable to other types of comminuting and grinding down equipment.

A typical wood hogger comminuting wood is fed various types of wood and timber material, which are then broken into smaller size pieces. Typically grinding discs or drums are used in a variety of different types and designs of apparatus for comminuting wood material. Generally these discs and drums bear a plurality of teeth like protuberances which impact with the wooden material, or other materials being fed in.

However, in practice and even for wood, high wear is often seen. Some types of wood hoggers (which is a device typically for breaking down waste timber material into a low grade fuel called hog fuel) can suffer quite high wear due to continued contact with the material being processed, this being a consequence of their design, the materials being processed, and whether they are being overfilled during use. Accordingly most modern designs of grinding discs and drums have evolved to have replaceable teeth as opposed to teeth which are formed, welded, or otherwise cast into the main body of the drum or disc—which still exist in some designs.

A further problem associated with tooth wear is damage caused by impact with foreign material. Quite commonly steel and rocks may find their way into wood hogging apparatus (for instance) and can cause severe damage to teeth. The consequence of such impacts is sometimes more severe when a hard item is encountered when processing soft material, than when processing exclusively harder materials. However, in all situations the teeth will wear and may need to be replaced. For devices which are being used in a variety of roles (e.g. the typical wood hogger used for comminuting harder materials) there may also be a need to substitute teeth with those tipped with different materials. Regardless of the reason, teeth should be able to be completed as quickly as possible to avoid extended down periods for the apparatus while repairs, modifications, or maintenance are performed.

The problem with most prior art tooth designs are that while the tooth design is quite simple, the holder is relatively complex in design. The problem here is that they are more expensive to produce (though the replacement teeth may be relatively inexpensive) and often require discs and drums of specific design to be prepared so that the complex tooth holders can be fitted. This adds to the overall cost of constructing the original apparatus.

It is also common to find that the wear of teeth is predominately on one side, as most apparatus is designed to rotate in one particular direction only. Most current designs do not allow the orientation of the teeth or disc to be easily or quickly changed, and neither to they allow for reverse operation of the disc—which would often conflict with the operational design of the whole apparatus.

Accordingly there is a need in the industry for an alternative design which allows teeth, for use in grinding discs and drums, to be simply fitted, easily changed, and ideally also being able to be easily rotated to allow both sides of the tooth to be exposed to wear.

It is an object of the present invention to provide an improved replaceable tooth design which does not require a complex holder assembly for fitting to at least a grinding disc or port thereof.

It is an object of the present invention to address the problems of the prior art.

At the very least it is an object of the present invention to provide the public with a useful alternative.

GENERAL DESCRIPTION OF THE INVENTION

According to one aspect of the present invention there is provided a tip portion for use in a replaceable tooth arrangement, said tip portion comprising a tip body portion and a tooth element, the tip body portion being configured to interact with a complementary base portion.

According to another aspect of the present invention there is provided a tip portion, substantially as described above, in which said complementary base portion with which the tip portion interacts comprises a second tip portion.

According to another aspect of the present invention there is provided a tip portion, substantially as described above, in which both tip portions are of substantially identical tip body portion design.

According to another aspect of the present invention there is provided a tip portion, substantially as described above, in which the complementary base portion comprises a base element with a body portion adapted to interact with securing means for its attachment to a device in which the tooth is to be used.

According to another aspect of the present invention there is provided a tip portion, substantially as described above, in which the tip portion is for use in a grinding or chipping disc.

According to another aspect of the present invention there is provided a tip portion, substantially as described above, in which said disc comprises multiple sections, and the tip portion is for use in one of said section.

According to another aspect of the present invention there is provided a tip portion, substantially as described above, in which the tip body portion is substantially circular in cross-section.

According to another aspect of the present invention there is provided a tip portion, substantially as described above, in which the tip body portion is tapered, such that the cross-section diameter changes along the length of the tip body portion.

According to another aspect of the present invention there is provided a tip portion, substantially as described above, in which the tip body portion is tapered such that its cross-sectional diameter decreases towards the end distal to the tooth element.

According to another aspect of the present invention there is provided a tip portion, substantially as described above, which is keyed or configured to be inserted into a disc, or section thereof, in a preferred rotational orientation.

According to another aspect of the present invention there is provided a tip portion, substantially as described above, in which the tip body portion is substantially polygonal along at least part of its length.

According to another aspect of the present invention there is provided a tip portion, substantially as described above, in which the bottom face of the tip body portion, distal to the end with the tooth element, is tapered.

According to another aspect of the present invention there is provided a tip portion, substantially as described above, in which the angle of tapering is within the inclusive range 15°-75° relative to the longitudinal axis of the tip body portion.

According to another aspect of the present invention there is provided a tip portion, substantially as described above, in which the angle of tapering is within the inclusive range 30°-60° relative to the longitudinal axis of the tip body portion.

According to another aspect of the present invention there is provided a tip portion, substantially as described above, which includes means for a connection element to pass therethrough to said complementary base portion.

According to another aspect of the present invention there is provided a tip portion, substantially as described above, in which said means comprises a longitudinal aperture passing through the tip body portion.

According to another aspect of the present invention there is provided a tip portion, substantially as described above, in which the connection element comprises a bolt.

According to another aspect of the present invention there is provided a tip portion, substantially as described above, in which there is included a wedge keeper through which said connection element also passes.

According to another aspect of the present invention there is provided a tip portion, substantially as described above, in which the connection element comprises a bolt, and the wedge keeper sits between the head of, or nut associated with, said bolt and the tip body portion.

According to another aspect of the present invention there is provided a tip portion, substantially as described above, in which at least part of the wedge keeper contacting the tip body portion is tapered relative to the longitudinal axis of the tip body portion, and wherein the tip body portion includes a removed portion for accommodating the wedge keeper and wherein said removed portion has faces, which contact the wedge keeper, which are tapered at substantially the same angle as the wedge keeper.

According to another aspect of the present invention there is provided a tip portion, substantially as described above, in which the relationship between the wedge keeper and tip body portion is such that if the wedge keeper is moved in a direction towards the end of the tip body portion distal the tooth element there is also a resultant outward component, perpendicular to the longitudinal axis of the tip body portion, in its resulting movement.

According to another aspect of the present invention there is provided a tip portion, substantially as described above, in which the tooth element is integrally formed with the tip body portion.

According to another aspect of the present invention there is provided a tip portion, substantially as described above, in which the tooth element has been subjected to a hardening process.

According to another aspect of the present invention there is provided a tip portion, substantially as described above, in which the tooth element has been coated with a hardened or abrasive material.

According to another aspect of the present invention there is provided a tip portion, substantially as described above, in which the tooth element comprises a material selected from the group comprising: hardened steels, tungsten carbides, ceramic materials, materials with embedded particles of diamond, boron nitride, composite materials including a hard substance.

According to another aspect of the present invention there is provided a tip portion, substantially as described above, in which the tooth element is substantially chisel like in appearance.

According to a further aspect of the present invention there is provided a tip portion for use in a replaceable tooth arrangement, said tip portion comprising a tip body portion and a tooth element, the tip body portion being configured to interact with a complementary base portion, the tip body portion including a longitudinal axis allowing a longitudinally directed connection element to pass through for connection to said base portion;

the bottom end of the tip body portion being tapered, such that when said connection element is tightened contacting tip and base portions attempt to move in a direction with both a longitudinal and outward, perpendicular to the longitudinal, component;

said outward component being such to tighten the tip and base portions against the walls of an aperture if said tip and base portions are inserted into same.

According to a further aspect of the present invention there is provided a complementary base portion for use with a tip portion, substantially as described above, said complementary base portion comprising a base body portion whose upper contacting face, for contacting said tip portion, is contoured to be complementary to same.

According to another aspect of the present invention there is provided a complementary base portion, substantially as described above, in which the cross-sectional configuration of the base body portion is equivalent to that of said tip portion.

According to another aspect of the present invention there is provided a complementary base portion, substantially as described above, in which there is provided a longitudinal aperture in the base body portion for accepting a connection element for connecting the base and tip portions together.

According to another aspect of the present invention there is provided a complementary base portion, substantially as described above, in which the connection element is a bolt, and at least part of said longitudinal aperture is threaded to allow the connection of the bolt.

According to another aspect of the present invention there is provided a complementary base portion, substantially as described above, in which there is provided a locating pin passing through an aperture in said base body portion which intersects with said longitudinal aperture, said locating pin including a threaded aperture for the connection of a connection element comprising a bolt.

According to a further aspect of the present invention there is provided a replaceable tooth arrangement comprising a tip portion, substantially as described above, in combination with a complementary base portion comprising either another tip portion, or a base portion substantially as described above.

According to another aspect of the present invention there is provided a replaceable tooth arrangement, substantially as described above, which includes a connection element for connecting the tip portion and complementary base portion.

According to another aspect of the present invention there is provided a replaceable tooth arrangement, substantially as described above, in which the connection element is a bolt.

According to another aspect of the present invention there is provided a replaceable tooth arrangement, substantially as described above, characterised such that tightening the connection element moves contacting tip and complementary base portions in a direction having both a longitudinal and outward, perpendicular to the longitudinal, component.

According to another aspect of the present invention there is provided a replaceable tooth arrangement, substantially as described above, in which said outward component is such that, when the tooth arrangement is inserted into an accommodating aperture, said outward component tightens the tip and base portions against the walls of said accommodating aperture.

According to a further aspect of the present invention there is provided a grinding disc which includes at least one replaceable tooth arrangement, substantially as described above.

According to a further aspect of the present invention there is provided a section for a grinding disc which includes at least one replaceable tooth arrangement, substantially as described above.

The following terms will be defined for use in the present specification. The term 'disc', unless otherwise specified, represents a substantially cylindrical element which may be thick or thin. Hence a drum, which is a thick cylinder, shall be considered to fall within the term 'disc'. A disc shall also relate to a substantially unitary device, or an assembly of multiple portions.

The present invention includes a tip portion which may be fitted to at least one other component or assembly to provide a replaceable tooth arrangement. This other component or assembly may take a number of forms according to the intended application of the present invention. Hence in its simplest form the present invention will comprise a tip portion while in another form it may comprise a tooth arrangement including at least one tip portion. Such tooth arrangements will find applications in grinding discs. For the purposes of this specification 'grinding disc' will refer to any disc (as defined above) used in any type of comminuting, chipping, grinding, breaking, or crushing process—i.e. any process which reduces an item into smaller pieces.

It is perhaps best to describe the tip portion first. Typically this will comprise a tooth element which is attached, connected, or formed into a tip body portion. In most cases it is envisaged that this tip portion will not be able to be used on its own and will require attachment to another component or assembly, which shall be referred to as the complementary base portion, before it can be used on most types of grinding apparatus. This is the case for preferred embodiments, but need not necessarily be the case in every instance.

The tip portion is generally also characterised by including provision for its attachment to the base portion. While this may take a number of forms the preferred arrangement is to allow at least one connection element, preferably a bolt, to pass through the tip body portion for securing to the complementary base portion. Generally this connection is substantially longitudinally with respect to the body of the tip portion, and typically comprises the connection element passing through a longitudinal aperture in the tip body portion, and typically also an aperture in the base portion. In practice, also, this connection element will absorb some of the energy of impacts of the tooth against hard and foreign materials. If sufficiently severe the connection element will typically be sacrificed rather than the tooth body.

While in its simplest form the provision for a connecting bolt may simply comprise an aperture through the tip body portion, and a suitable face for seating the bolt, preferred embodiments have a tapered wedge keeper to further improve the performance of the present invention. This keeper is typically a wedge or tapered element which, if moved downwardly with respect to the tip body portion, will also be moved slightly outwardly—i.e. perpendicularly to the longitudinal axis of the tip body portion. This may be achieved by providing suitably inclined faces on both the keeper and on the walls of recessed portions of the tip body portion for accommodating the keeper. In practice this keeper will be intermediate the head of a connection element comprising a bolt (or a nut) and the tip body portion. In practice also, the tip body portion, and keeper, will be inserted into a suitable locating aperture in a grinding disc, drum, or part thereof. Once inserted, outward movement of the keeper would not be permitted. Hence attempted downward movement of the keeper, by the retaining bolts, will in fact cause the keeper to wedge more tightly within the recess defined by the inclined recess walls of the tip body portion, and against the wall of the aperture into which the tip portion with keeper has been inserted. This very effectively tightens the whole arrangement within the provided locating aperture to ensure that there is no slack, or loose movement.

In preferred embodiments of the present invention the bottommost face of the tip portion is tapered, though the invention in its broadest form includes a bottom face substantially perpendicular to the longitudinal axis. Tapering can provide for a number of other potentially realisable advantages or features. The preferred degree of tapering is 15°-75° inclusive of the longitudinal axis, and more preferably 30°-60° inclusive. This taper also allows for energy transmission and some absorption, due to relative movement, should a tooth or tip portion be subjected to a high impact. This can preserve the life of a tip portion under normal or adverse conditions.

For instance, this tapering will allow two identical tip portions to be placed longitudinally end to end, with one of the two tip portions affectively acting as a base portion for the other. In such a case tightening the connecting bolt (associated with the keeper) will serve to draw the two tip portions towards each other. The tapering of their contacting faces again causes them to move slightly laterally as well as towards each other. Again, when the assembly is placed within a locating aperture within a grinding disc or such like, tightening of the bolt actually serves to further tighten the assembly within the aperture. This is particularly important in a situation where the assembly is being mounted into an aperture connecting, say, front and rear faces of the disc. Here the only means by which the components may be held in place (depending on the embodiment) may be by outward pressure of the inserted components against the sides of the locating aperture in which the assembly is fitted, as a consequence of the retaining bolt being tightened.

As another variation the complementary base portion may comprise merely a base body portion able to be connected to a grinding disc, drum, or part thereof. In the preferred embodiment this base portion merely comprises a blind wedge whose top face is contoured to match the bottom face of the other tip portion. Suitable means for connection of this base portion to the grinding disc, etc, should be provided. This may merely comprise a threaded aperture into which a bolt may be tightened from outside. However, in a preferred embodiment there is a provided an aperture in the body of the base portion through which a pin may be passed. This pin may have a threaded aperture within it so that once having passed through the grinding disc (or part thereof etc) and through the body of the base portion itself, the retaining bolt for the tip portion can be inserted into the threaded aperture and tightened. As a result the assembly, and tip portion, is tightly secured against removal from the locating aperture for the assembly, as well as being prevented from rotation within the locating aperture provided for the assembly.

Construction of the various components may vary. For ease of construction, and economy, it is considered that the majority of components may be cast, and preferably of a suitably hard material. The tip portion generally has the highest requirement, and particularly the tooth portion thereof. Consequently the tooth portion may be manufactured separately and subsequently fastened to the tip portion, or alternatively the entire tip portion may be cast as one. The actual tooth portion may then be machined, according to user preference, to achieve the appropriate contours and sharpness of edges which may be desirable for a tooth. In preferred embodiments high strength and high hardness steels are used for the tooth portion, with the entire tip portion with tooth portion then cast as one unit. Other components, which may be subjected to less wear, may be formed of other types of steel or materials.

The tooth portion may also be formed or coated with a variety of hard or abrasive materials. These may be a material selected from the group comprising: hardened steels, tungsten carbides, ceramic materials, materials with embedded particles of diamond, boron nitride, composite materials including a hard substance.

In preferred embodiments of the present invention the main body of the tip portion, and also the main body formed by the union of the tip portion with base portion, is preferably circular in cross section. By utilising a circular cross section, the accommodating aperture within the grinding disc (or drum etc) may be easily formed by drilling a suitably sized aperture. While other shapes may be provided for in various other embodiments and need not be of constant cross-section (e.g. conical or part conical sections), this increases the difficulty of forming the appropriately shaped aperture within the grinding disc etc. However, this does not preclude their use—non circular (cross-section) embodiments would be less likely to rotate within the aperture.

It is also possible in certain embodiments that keyed features may be provided in the various body portions and/or accommodating recess/apertures in the grinding disc etc. This is particularly useful if one is attempting to prevent rotation of the replaceable tooth assembly. While certain embodiments such as those having a blind wedge and lateral pin as a base portion are resistant to rotation, other arrangements are not necessarily so. One example is where two tip portions are used end to end. Here various recesses for insertion of a key, or key and recessed features may be provided in either or both of the body portions and/or the locating apertures in the grinding disc (etc). It is considered that in most applications where end to end tip portions are used, tightening the bolt (with the components being subsequently forced against the aperture walls) will be sufficient to prevent rotation under normal conditions. However it is also envisaged that there may be applications where the additional security of the keyed arrangement may be required.

Various modifications may be made to different embodiments of the invention. For instance, the locating aperture for a tooth assembly need not be at 90° to the surface from which it protrudes. It may be angled, preferably so That the tooth end faces into the direction of travel. This can further improve resistance to impacts.

Locating apertures for the tooth arrangement need not be substantially cylindrical and may adopt other configurations including, but not restricted to, conical, parabolic in side section, hyperbolic in side section, or parts thereof.

DESCRIPTION OF PREFERRED EMBODIMENT

Figure 1:
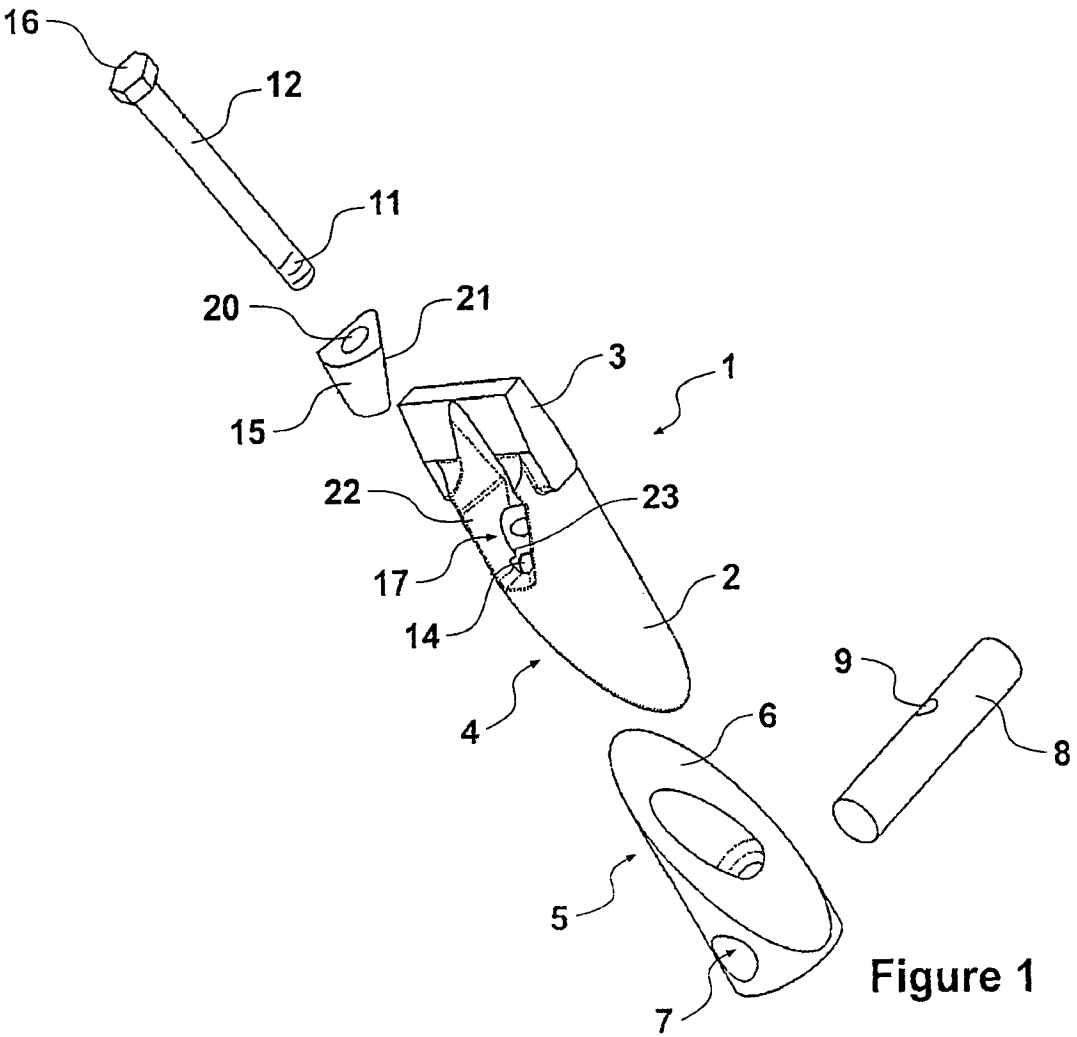
FIG. 1 is an exploded diagrammatic view of one preferred embodiment of the present invention.

With reference to the drawings and by way of example only, FIG. 1 illustrates a tip portion, generally indicated by arrow 1. This comprises a body portion (2) and tooth portion (3). From this arrangement the entire tip portion (1) is cast as a single unit with the tooth portion (3) then machined to the general contour illustrated in FIG. 1.

Figure 2:
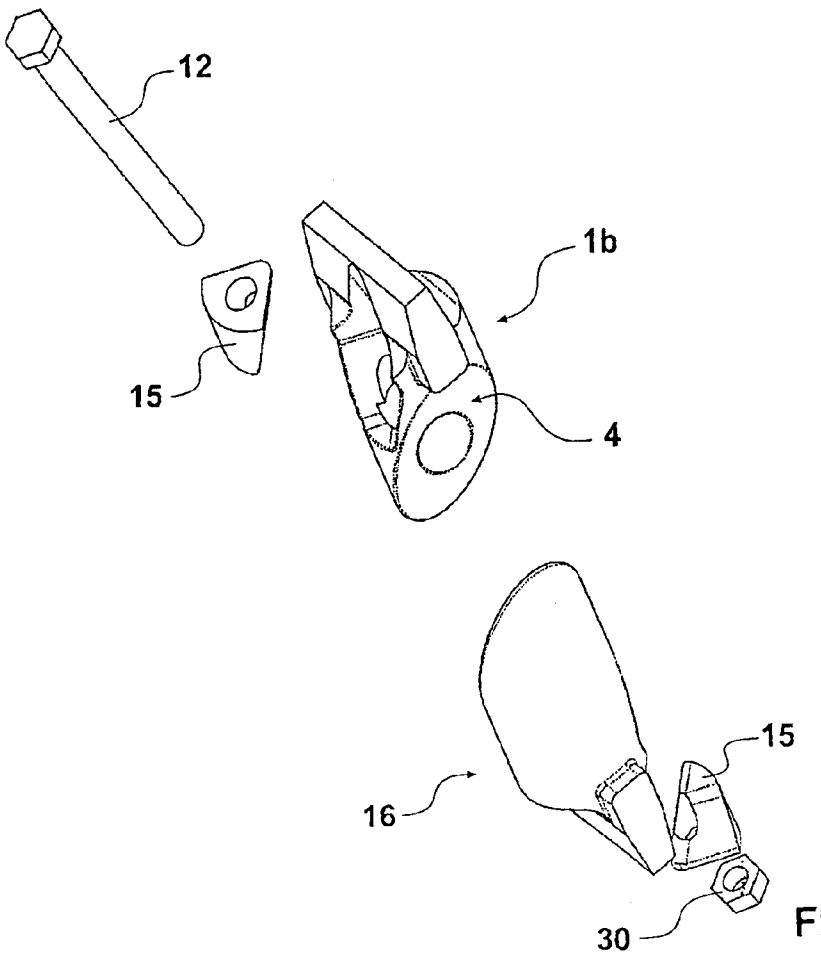
FIG. 2 is an exploded diagrammatic view of an alternative arrangement of the present invention utilising the tip portion of FIG. 1.

Not clearly visible in FIG. 1 is the tapering of the bottom face (4) of the tip portion (1), though this is more clearly seen in FIG. 2. Referring to FIG. 1 it should be appreciated that the tapering of the bottom face (4) of tip portion (1) is comparable and substantially complementary to the tapering of the top face (6) of base or wedge portion (5).

The complementary base portion (5) allows the tip portion (1) to be mounted into a suitable locating aperture in a grinding disc, drum, or part thereof. This may be a blind hole drilled into the grinding disc etc. It is envisaged that the embodiment of FIG. 1 is more likely to be used in an arrangement where it represents a circumferential tooth on a grinding disc. This allows a further aperture to be drilled from the front through to the rear face of the grinding disc to accommodate locating pin (8) which passes through said aperture of the disc and through provided aperture (7) within the base or portion (5). A threaded aperture (9) within the retaining pin (8) allows the threaded end (11) of retaining bolt (12) (the term 'bolt' within this specification includes any threaded connection element) to be fastened therein.

The retaining bolt (12) passes through an aperture (14) in the body (2) of tip portion (1). In practice a wedge keeper (15) sits between the head (16) of the retaining bolt (12) and the body (2) of the tip portion (1). This wedge shape keeper fits into an appropriately shaped recess (17) provided in the body (2) of tip portion (1). The inner most contacting walls (20, 21)

of the keeper (15) are inclined downwardly and outwardly and correspond to an inclination on the walls (22, 23) of the recess (17) provided in the tip body portion (1). As previously mentioned in the specification the result of this tapering is that pushing the keeper (15) downwardly will attempt to also move it outwardly.

Figure 4:
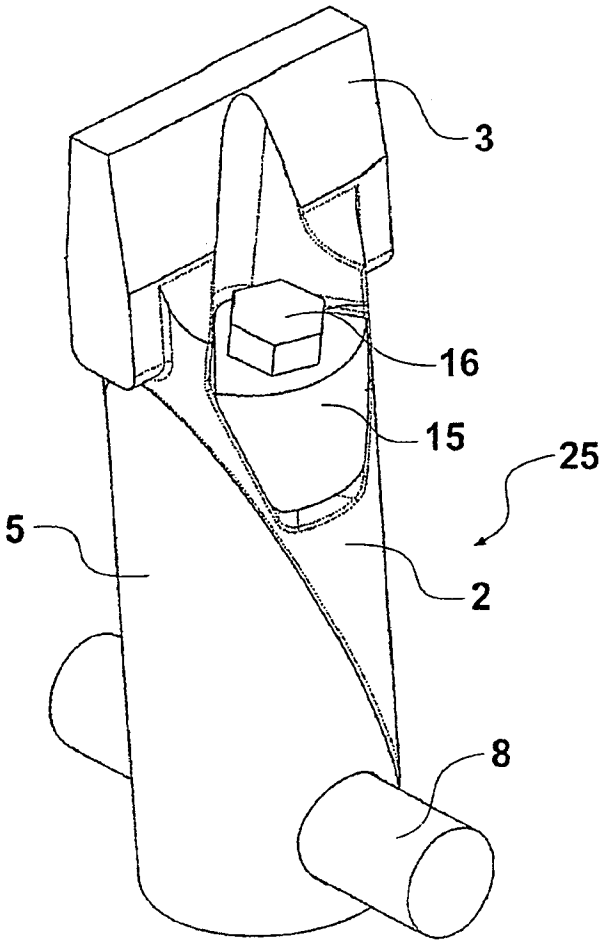
FIG. 4 is a perspective diagrammatic view of the assembled embodiment of FIG. 1.
Figure 5:
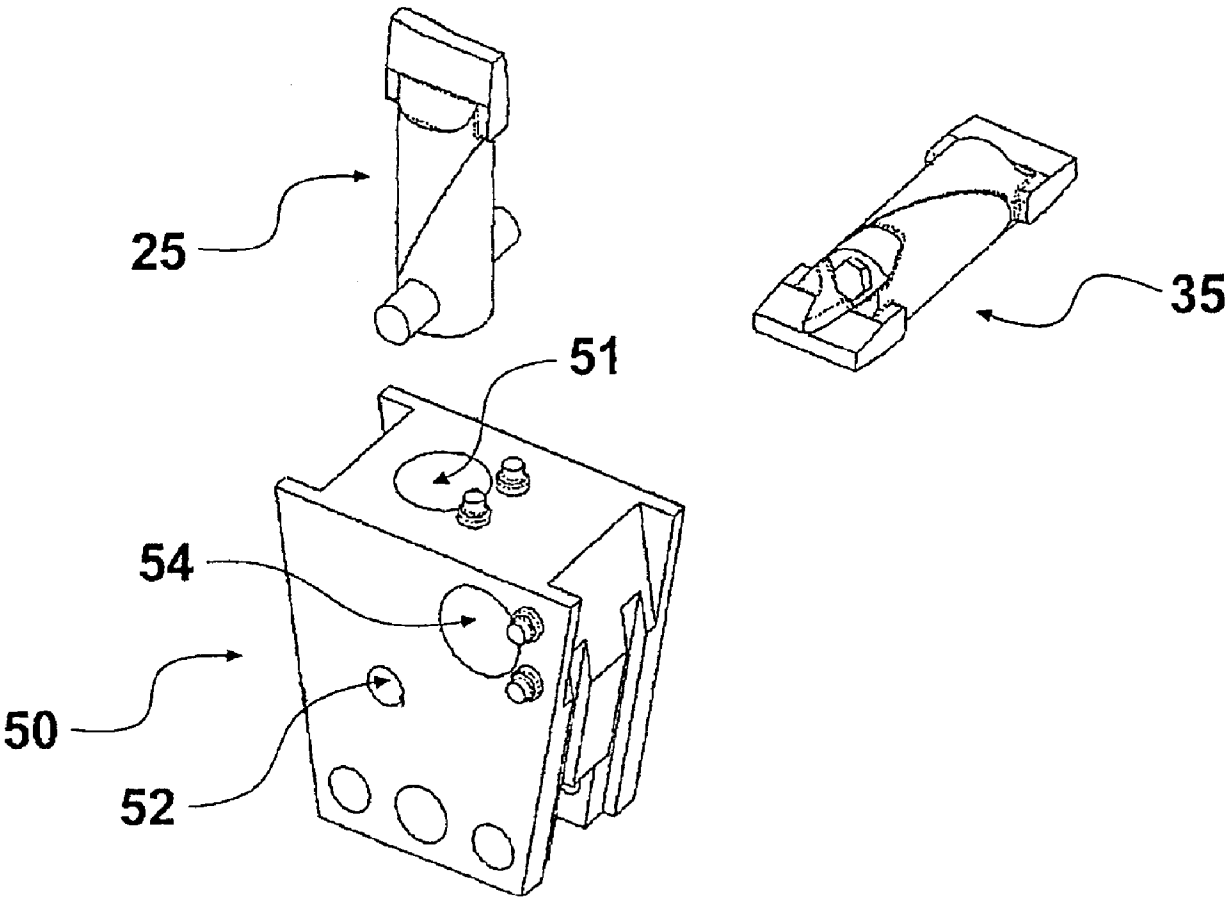
FIG. 5 is a perspective diagrammatic view of an embodiment of a disc section into which the embodiments of FIGS. 3 and 4 may be fitted.

FIG. 4 shows the embodiment of FIG. 1 once it has been assembled. FIG. 5 illustrates a section of a grinding disc into which the completed assembly (25) is mounted. In practice tightening the bolt (16) pushes the keeper (15) outwardly against the inner wall of the accommodating aperture (51) for the assembly (25). Further tightening also tends to displace the body portions (2 and 5) outwardly further wedging the assembly (25) within the provided aperture (51). The presence of retaining pin (8) in aperture 52 also further secures the assembly (25) against removal from the element (50) in which it is fastened, as well as also preventing its rotation.

In FIG. 2 we can see a slightly different embodiment of the present invention where two identical tip portions (1*a*, 1*b*) are used end to end. In this case the tapering of bottom face (4) remains the same. The use of keeper (15) also remains the same. The only difference is that a base portion (5) of FIG. 1 has been replaced by an identical tip portion (1*b*).

A retaining bolt (12) is still relied upon to secure the two portions together, the difference being that instead of a retaining pin (8) a nut (30) with optional washer is used.

Figure 3:
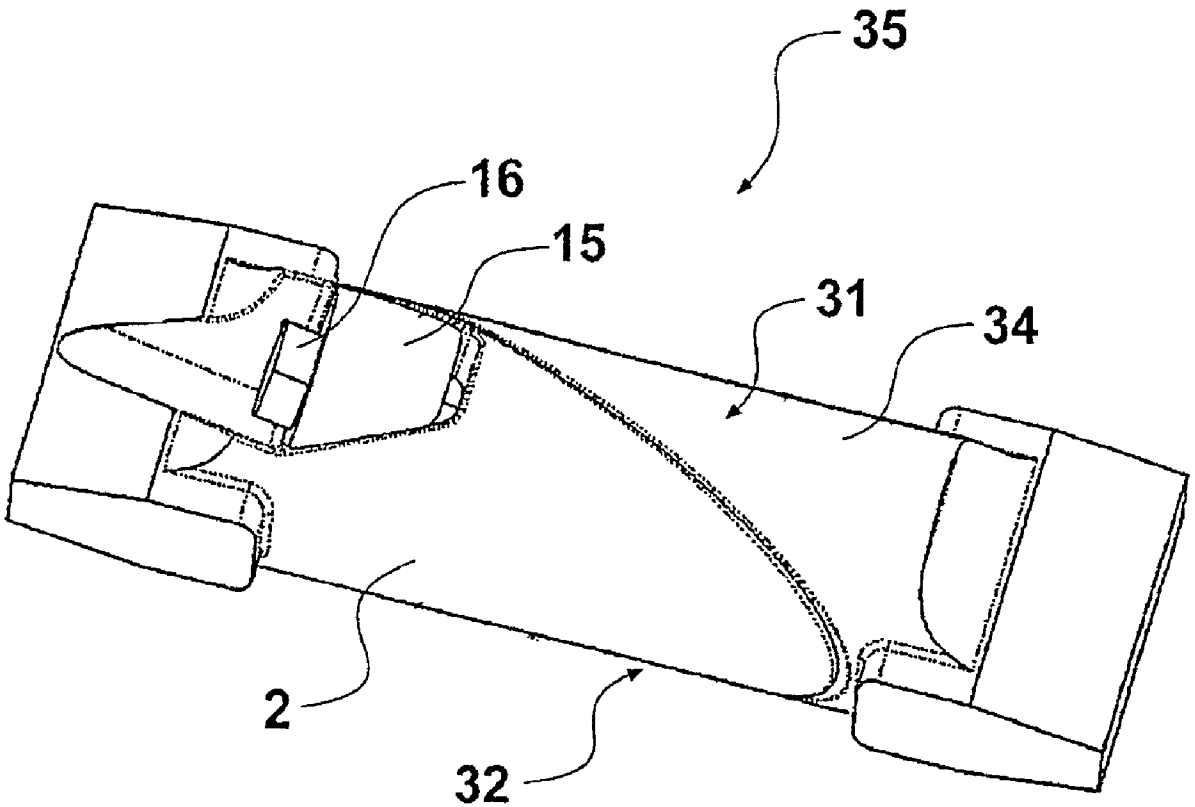
FIG. 3 is a perspective diagrammatic view of the embodiment of FIG. 2.

The completed arrangement can be clearly seen in FIG. 3. This type of arrangement is best used in the situation where the tooth is to be mounted such that one tooth is present on opposing faces of grinding equipment—such as a disc (60) or section (50) thereof. In this arrangement rotation within the provided aperture (54) for assembly (35) is possible. However rotation is minimised by the fact that tightening the bolt (12) serves to press the keeper (15) and outer walls (31, 32) of the body portions (2, 34) apart. This effectively wedges or jams the assembly (35) within the provided aperture (54) making rotation difficult. If necessary, suitable modification may be made by merely loosening the retaining bolts (12) rotating the assembly (35) to the correct orientation, then retightening bolt (16).

Figure 6:
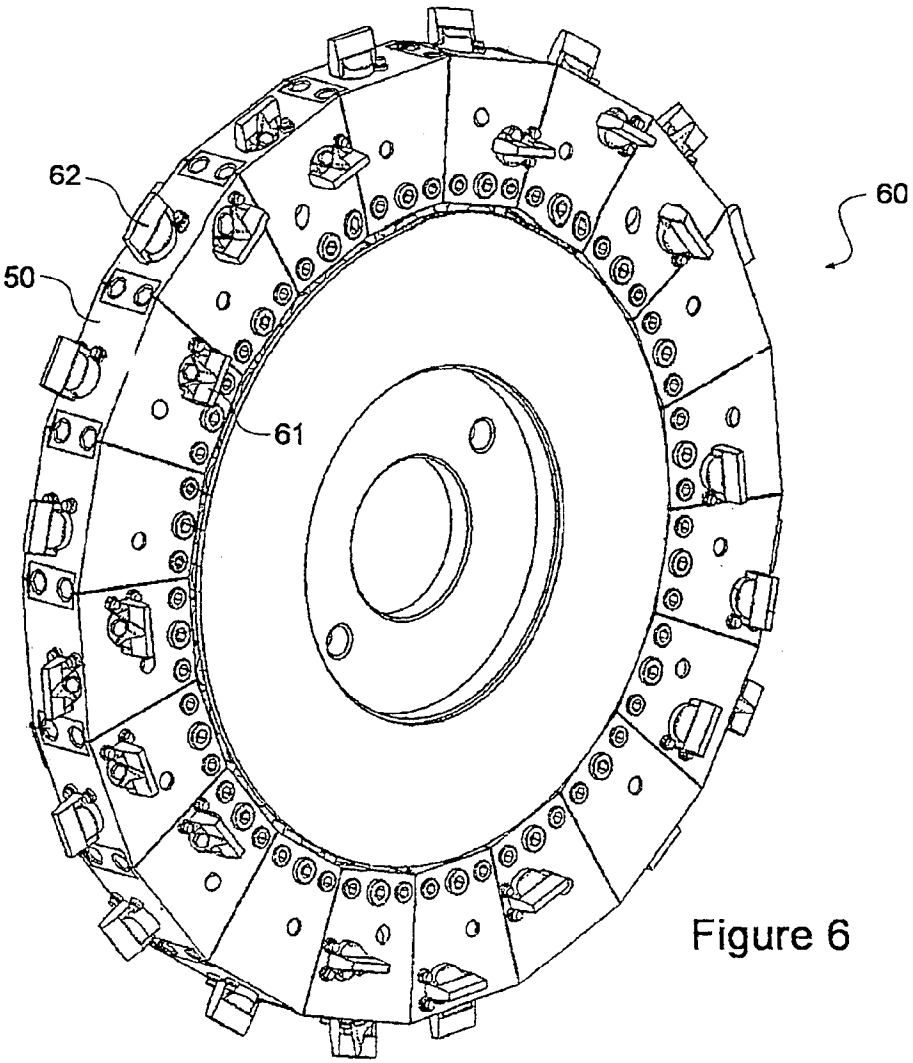
FIG. 6 is a perspective diagrammatic view of a preferred embodiment of a grinding disc incorporating tooth arrangements of the present invention.

FIG. 6 illustrates a preferred embodiment of a grinding disc (60). This is composed of sections (50), though need not be, and incorporates both tooth arrangements (61) comprising connected identical tip portions (such as (4) in the other figures) and arrangements (62) comprising tip portions (such as (4) in the other figures) connected to complementary base portions (such as (5) in the other figures).

In practice the present invention can provide a number of potentially realisable advantages over the prior art. For instance the generally simpler design should provide manufacturing advantages over the prior art. As simplicity of design is also more ideally suited to the type of environment in which it is likely to be used, it can thus becomes a more readily expendable or replaceable item. The design also allows for much quicker replacement of components, ready removal, or changing of orientation, as may be required.

Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list This specification is also based on the understanding of the inventor regarding the prior art. The prior art description should not be regarded as being authoritative disclosure: on the true state of the prior art but rather as referencing considerations brought to the mind and attention of the inventor when developing this invention.

What I claim is:

1. A replaceable tooth for use in a replaceable tooth assembly, said replaceable tooth comprising:

a body portion; and a tooth portion, said body portion extending along a longitudinal axis through said body portion, and said tooth portion being attached at one end of said body portion, a bottom face of the body portion, distal to the one end of said body portion where the tooth portion is attached, being tapered in a plane angled to the longitudinal axis, the body portion including a longitudinal aperture through said body portion configured to receive a connection element, the longitudinal aperture extending from the tapered bottom face of the body portion to a shaped recess of the body portion being formed near to said tooth portion, the shaped recess extending inwardly from a side of the body portion and extending longitudinally upward towards said tooth portion from a point partway along a length of said body portion, and the shaped recess having at least two sides tapering outwardly relative to the longitudinal axis in a longitudinal direction towards said tooth portion.

2. The replaceable tooth as claimed in claim 1, wherein the connection element comprises a bolt, and wherein said tapered shaped recess accommodates a wedge shaped keeper positionable between either of a head of said bolt or a nut associated with said bolt.

3. The replaceable tooth as claimed in claim 2, wherein the wedge keeper and the body portion are configured such that a movement of the wedge keeper in a longitudinal direction towards the tapered bottom end of the body portion urges the wedge keeper in an outward movement perpendicular to the longitudinal axis of the body portion.

4. The replaceable tooth as claimed in claim 2, wherein said connection element connects said replaceable tooth to a complementary base portion such that a contacting face of the complementary base portion connects to and is complementary to the tapered bottom face of the body portion.

5. The replaceable tooth as claimed in claim 1, further comprising:

a complementary base portion including a top face, said top face being complementary to the tapered bottom face of the body portion and configured to be connected to the tapered bottom face of the body portion and secured thereon by the connection element.

6. The replaceable tooth as claimed in claim 1, wherein the body portion has rotational symmetry about an axis perpendicular to said longitudinal axis such that for two tip portions rotated 180° relative to each other about said rotational symmetry axis, the respective longitudinal apertures are aligned to allow a connection element to pass through to connect them.

7. The replaceable tooth as claimed in claim 1, wherein the replaceable tooth is configured for use in a grinding or chipping disc.

8. The replaceable tooth as claimed in claim 1, wherein the cross-sectional shape of the body portion, when viewed in a direction along the longitudinal axis, is substantially circular.

9. The replaceable tooth as claimed in claim 1, wherein the body portion is tapered such that cross-sectional dimensions decrease along a length of the tip body portion towards the tapered base portion.

10. The replaceable tooth as claimed in claim 1, wherein the body portion is of polygonal cross-section along at least part of the length.

11. The replaceable tooth as claimed in claim 1, wherein the angle of tapering of the plane on the bottom face of the body portion ranges from 15°-75° relative to said longitudinal axis of the body portion.

12. The replaceable tooth as claimed in claim 11, wherein the angle of tapering on the bottom face of the body portion ranges from 30°-60° relative to the longitudinal axis of the body portion.

13. The replaceable tooth as claimed in claim 1, wherein the tooth portion is integrally formed with the body portion.

14. The replaceable tooth as claimed in claim 13, wherein the tooth portion has been subjected to a hardening process.

15. The replaceable tooth as claimed in claim 1, wherein the tooth portion is coated with a hardened or abrasive material.

16. The replaceable tooth as claimed in claim 1, wherein the tooth portion comprises a material selected from the group comprising of hardened steels, tungsten carbides, ceramic materials, materials with embedded particles of diamond, boron nitride, and composite materials including a hard substance.

17. The replaceable tooth as claimed in claim 1, wherein the tooth portion is substantially chisel-like in appearance.

18. The replaceable tooth as claimed in claim 1, wherein said replaceable tooth is fastened to a complementary base portion by a connection element.

* * * * *